US007942518B2

(12) United States Patent
Ogimura

(10) Patent No.: US 7,942,518 B2
(45) Date of Patent: May 17, 2011

(54) MEDIUM FEEDER AND LIQUID EJECTING APPARATUS OR RECORDING APPARATUS INCORPORATING THE SAME

(75) Inventor: Takafumi Ogimura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 964 days.

(21) Appl. No.: 11/716,486

(22) Filed: Mar. 8, 2007

(65) Prior Publication Data

US 2007/0252883 A1 Nov. 1, 2007

(30) Foreign Application Priority Data

Mar. 9, 2006 (JP) ..... P2006-063743

(51) Int. Cl.
*B41J 2/01* (2006.01)

(52) U.S. Cl. ..... 347/104

(58) Field of Classification Search ..... None
See application file for complete search history.

(56) References Cited

U.S. PATENT DOCUMENTS

| | | | | |
|---|---|---|---|---|
| 6,542,263 | B2 * | 4/2003 | Emmenegger et al. | 358/498 |
| 6,824,132 | B2 | 11/2004 | Asai et al. | |
| 2005/0140087 | A1 * | 6/2005 | Sano et al. | 271/276 |

FOREIGN PATENT DOCUMENTS

| | | |
|---|---|---|
| CN | 1401502 A | 3/2003 |
| JP | A-9-194083 | 7/1997 |
| JP | A-2001-278500 | 10/2001 |
| JP | U-3092370 | 12/2002 |

* cited by examiner

*Primary Examiner* — Manish S Shah
*Assistant Examiner* — Alexander C Witkowski
(74) *Attorney, Agent, or Firm* — Nutter McClennen & Fish LLP; John J. Penny, Jr.; Michael P. Visconti, III

(57) ABSTRACT

A medium feeder is operable to feed a target medium to a liquid ejecting section in which liquid is ejected toward the target medium. A feeding roller is adapted to come in contact with the target medium, thereby feeding the target medium along a feeding path in a first direction. A supporter is opposing the feeding roller and having a supporting face adapted to support the target medium. A releaser is movable between a first position entering the feeding path and a second position retreating from the feeding path, A driver is operable to place the releaser in the second position when a feeding operation of the feeding roller begins, and to place the releaser in the first position when a leading end of the target medium reaches the liquid ejecting section. An edge guide is provided on the supporter and has a guiding face adapted to come in contact with a side edge of the target medium at least when the releaser is placed in the second position. The releaser is adapted to push up the target medium at the first position thereof, so that the target medium is separated from the supporting face. The edge guide is formed with a concave portion adapted to oppose the side edge of the target medium pushed up by the releaser.

11 Claims, 8 Drawing Sheets

MEDIUM FEEDER AND LIQUID EJECTING APPARATUS OR RECORDING APPARATUS INCORPORATING THE SAME

BACKGROUND

1. Technical Field

The present invention relates to a liquid ejecting apparatus or a recording apparatus provided with a medium feeder operable to support and feed a target medium to be subjected to a liquid ejecting operation or a recording operation.

The liquid ejecting apparatus is not limited to a printer, a copier, or a facsimile which employs an ink jet recording head and ejects ink from the recording head to a recording medium, to thus effect recording. The liquid ejecting apparatus is employed to encompasses an apparatus that ejects a liquid appropriate to an application, in place of ink, from a liquid ejecting head corresponding to the ink jet recording head onto a target medium corresponding to a recording medium, thereby causing the liquid to adhere to the medium.

In addition to the recording head, the liquid ejecting head encompasses a coloring material ejecting head used for manufacturing a color filer such as a liquid-crystal display or the-shaped; an electrode material (conductive paste) ejecting head used for forming electrodes, such as an organic EL display or a field emission display (FED) or the-shaped; a bio-organic substance ejecting head used for manufacturing a bio-chip; a sample ejecting head serving as a precision pipette; and the-shaped.

The recording apparatus is not limited to a printer, a copier, or a facsimile which employs an ink jet recording head and ejects ink from the recording head to a recording medium, to thus effect recording. The recording apparatus is employed to encompasses an apparatus that performs recording on a recording medium in a dot-impact manner, a thermal transfer manner or an electrophotographic manner.

2. Related Art

An ink jet printer is an example of the recording apparatus or the liquid ejecting apparatus. In many cases, an ink jet printer is provided with a feeder (a so-called automatic sheet feeder) which can set a plurality of printing sheets serving as a recording medium or a target medium. Such a feeder has an edge guide for guiding an edge of a sheet as disclosed in Japanese Patent Publication No. 2001-278500A (JP-A-2001-278500). The edge guide is provided so as to be slidable in the widthwise direction of the sheet, as well as to be retained at an appropriate position corresponding to the size of the sheet. By such an edge guide, edges of sheets are aligned, and during feeding each of the sheets is fed in a correct attitude without being skewed.

However, on the other hand, when the side edge of the sheet is firmly restricted by the edge guide at the time of performing a recording operation on the fed sheet, a friction resistance occurs between the side edge of the sheet and a guide face of the edge guide serves as a transport load, thereby deteriorating a recording quality. In order to solve the problem, JP-A-2001-278500 discloses an edge guide provided with a plurality of convex portions adapted to come in contact with a side edge of the sheet with less friction resistance.

However, even though the above-mentioned edge guide is used, a friction resistance still occurs between the side edge of the sheet and the convex portions. Accordingly, since a transport load occurs, a recording quality is deteriorated. On the other hand, when the side edge of the sheet is not restricted at all, it is difficult to prevent the skew at the time of feeding the sheet in a case of a medium feeder in which a leading end of a sheet is once caught by a feeding roller and is then released backward for skew removal, when the side edge of the sheet is not restricted by the edge guide, the skew may not be duly removed.

SUMMARY

It is therefore an advantageous aspect of the invention to provide a medium feeder comprising an edge guide which surely restricts a side edge of a sheet at the time feeding the sheet and reduces the transport load caused by the edge guide at the time of performing a liquid ejecting operation or a recording operation.

According to one aspect of the invention, there is provided a medium feeder, operable to feed a target medium to a liquid ejecting section in which liquid is ejected toward the target medium, comprising:

a feeding roller, adapted to come in contact with the target medium, thereby feeding the target medium along a feeding path in a first direction;

a supporter, opposing the feeding roller and having a supporting face adapted to support the target Medium;

a releaser, movable between a first position entering the feeding path and a second position retreating from the feeding path;

a driver, operable to place the releaser in the second position when a feeding operation of the feeding roller begins, and to place the releaser in the first position when a leading end of the target medium reaches the liquid ejecting section; and an edge guide, provided on the supporter and has a guiding face adapted to come in contact with a side edge of the target medium at least when the releaser is placed in the second position, wherein:

the releaser is adapted to push up the target medium at the first position thereof, so that the target medium is separated from the supporting face; and the edge guide is formed with a concave portion adapted to oppose the side edge of the target medium pushed up by the releaser.

The supporter may be movable between a third position bringing the target medium in press contact with the feeding roller and a fourth position separating the target medium from the feeding roller. A lower end of the concave portion may be away from the supporting face when the supporter is placed in the fourth position. The concave portion may be opened upward.

The concave portion may be opened in the first direction.

The releaser may be a pivotable lever operable to return, to the supporter, a target medium second-closest to the feeding roller fed with a target medium closest to the feeding roller, by moving from the second position to the first position.

According to one aspect of the invention, there is provided a medium feeder, operable to feed a target medium to a liquid ejecting section in which liquid is ejected toward the target medium, comprising:

a feeding roller, adapted to come in contact with the target medium, thereby feeding the target medium along a feeding path in a first direction;

a supporter, opposing the feeding roller and having a supporting face adapted to support the target medium;

an edge guide, provided on the supporter and having a guiding face adapted to come in contact with a side edge of the target medium; and an edge releaser, operable to place the side edge of the target medium in a first position opposing the guiding face at least when a feeding operation of the feeding roller begins, and to place the side edge of the target medium in a second position free from the guiding face when a leading end of the target medium reaches the liquid ejecting section.

The edge releaser may comprise a releaser, movable between a third position entering the feeding path and a fourth position retreating from the feeding path. The releaser may be adapted to push up the target medium at the third position thereof, so that the side edge of target medium is placed in the second position.

The releaser may be a pivotable lever operable to return, to the supporter, a target medium second-closest to the feeding roller fed with a target medium closest to the feeding roller, by moving from the fourth position to the third position.

The supporter may be movable between a third position bringing the target medium in press contact with the feeding roller and a fourth position separating the target medium from the feeding roller. The edge releaser may be operable to place the supporter in the fourth position, so that the side edge of target medium is placed in the second position.

The edge guide may be formed with a concave portion adapted to oppose the side edge of the target medium placed in the second position.

According to one aspect of the invention, there is provided a liquid ejecting apparatus, comprising:

a liquid ejecting section;

a liquid ejecting head, disposed in the liquid ejecting section and operable to eject liquid toward a target medium; and any one of the above medium feeders.

According to one aspect of the invention, there is provided a recording apparatus, comprising:

a recording section;

a recording head, disposed in the recording section and operable to perform recording on a recording medium;

a medium feeder, adapted to feed the recording medium to the recording section, the medium feeder comprising:

a feeding roller, adapted to come in contact with the recording medium, thereby feeding the recording medium along a feeding path in a first direction;

a supporter, opposing the feeding roller and having a supporting face adapted to support the recording medium;

a releaser, movable between a first position entering the feeding path and a second position retreating from the feeding path;

a driver, operable to place the releaser in the second position when a feeding operation of the feeding roller begins, and to place the releaser in the first position when a leading end of the recording medium reaches the liquid ejecting section; and an edge guide, provided on the supporter and has a guiding face adapted to come in contact with a side edge of the recording medium at least when the releaser is placed in the second position, wherein:

the releaser is adapted to push up the recording medium at the first position thereof, so that the recording medium is separated from the supporting face; and the edge guide is formed with a concave portion adapted to oppose the side edge of the recording medium pushed up by the releaser.

According to one aspect of the invention, there is provided a recording apparatus, comprising;

a recording section;

a recording head, disposed in the recording section and operable to perform recording on a recording medium;

a medium feeder, adapted to feed the recording medium to the recording section, the medium feeder comprising:

a feeding roller, adapted to come in contact with the recording medium, thereby feeding the recording medium along a feeding path in a first direction;

a supporter, opposing the feeding roller and having a supporting face adapted to support the recording medium;

an edge guide, provided on the supporter and having a guiding face adapted to come in contact with a side edge of the recording medium: and an edge releaser, operable to place the side edge of the recording medium in a first position opposing the guiding face at least when a feeding operation of the feeding roller begins, and to place the side edge of the recording medium in a second position free from the guiding face when a leading end of the recording medium reaches the liquid ejecting section.

DETAILED DESCRIPTION OF THE EXEMPLARY EMBODIMENTS

Exemplary embodiments of the invention will be described below in detail with reference to the accompanying drawings.

Figure 1:
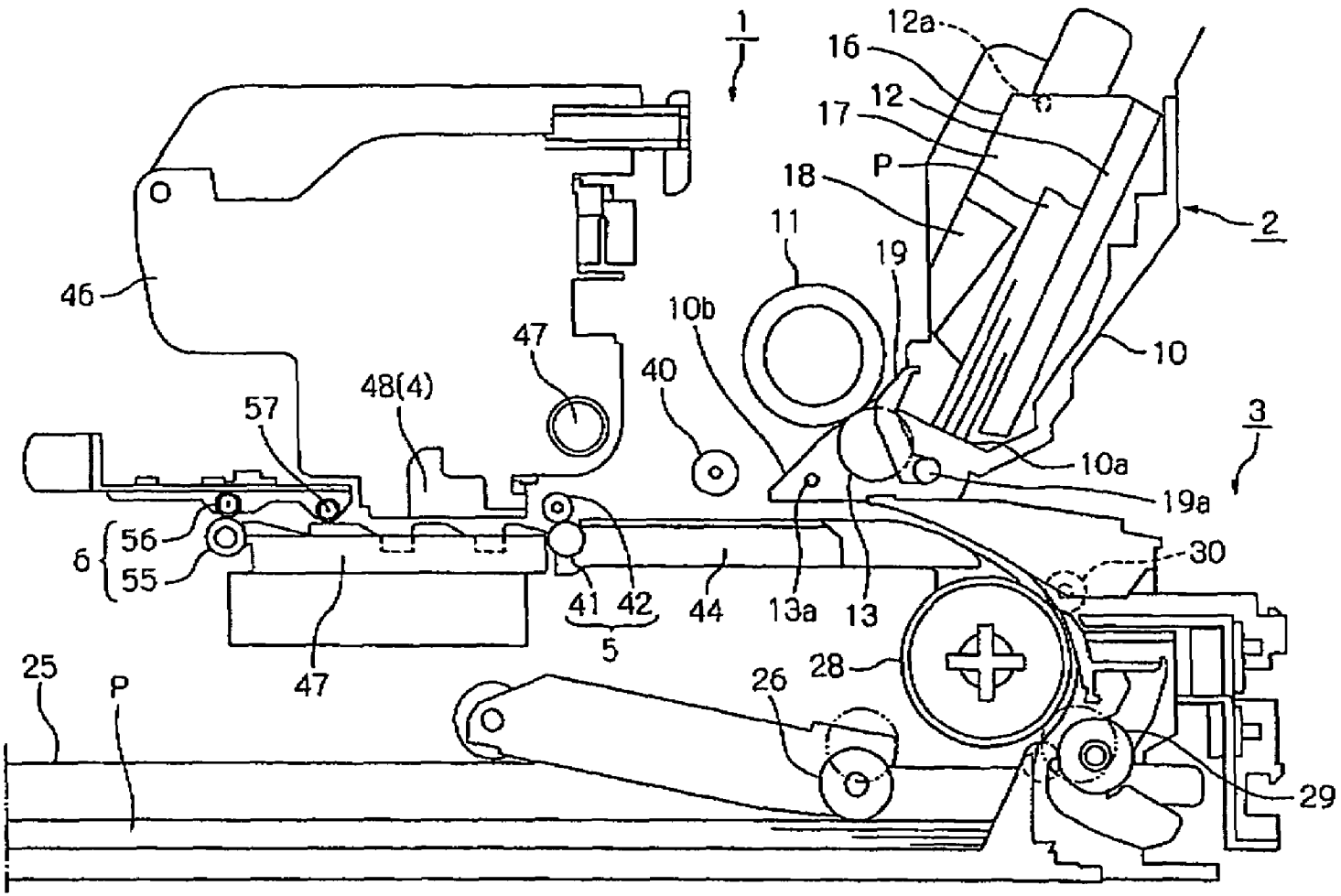
FIG. 1 is a schematic side view showing an internal configuration of an ink jet printer incorporating a medium feeder according to a first embodiment of the invention.
Figure 2:
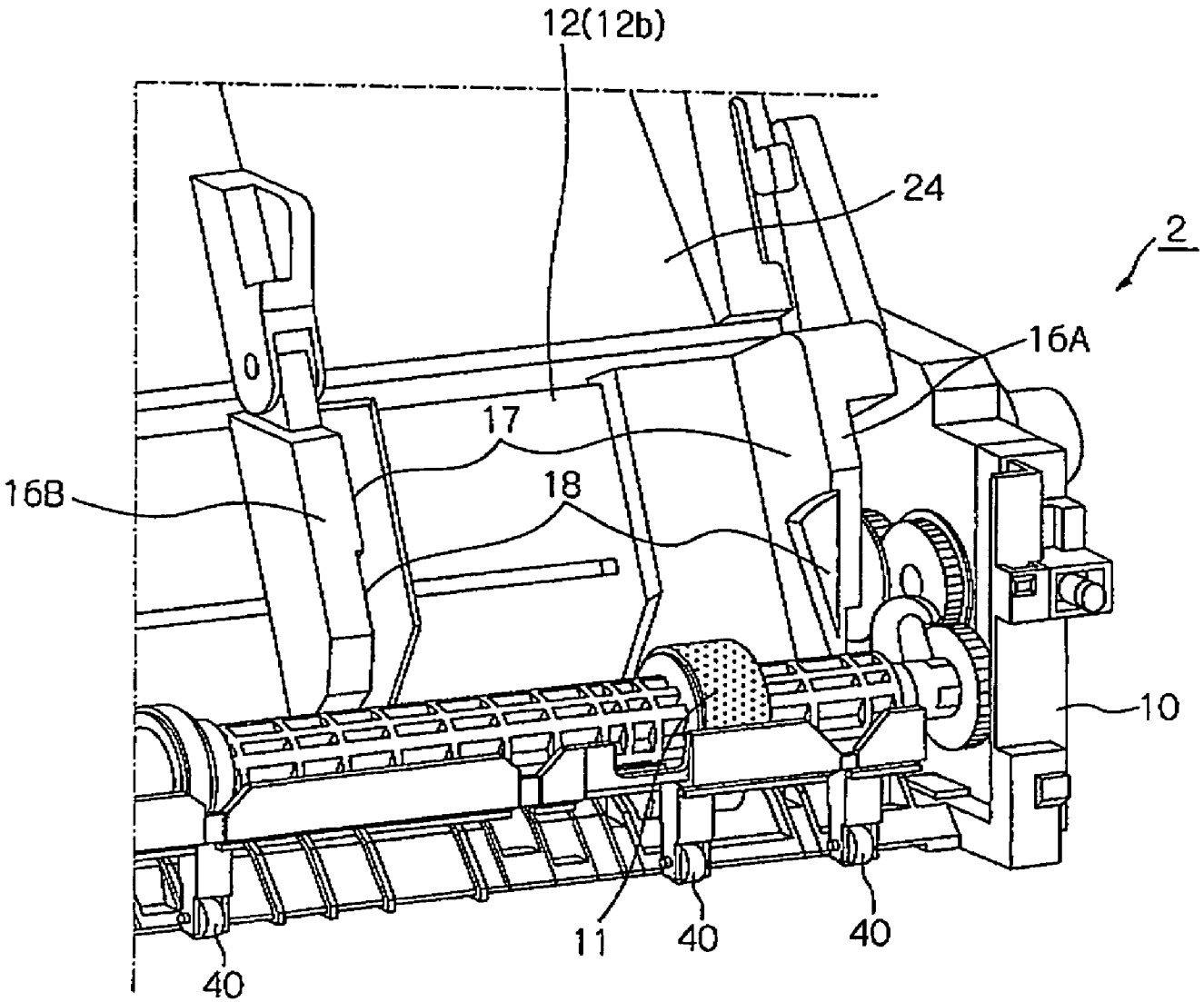
FIG. 2 is a partial perspective view of the medium feeder.
Figure 3:
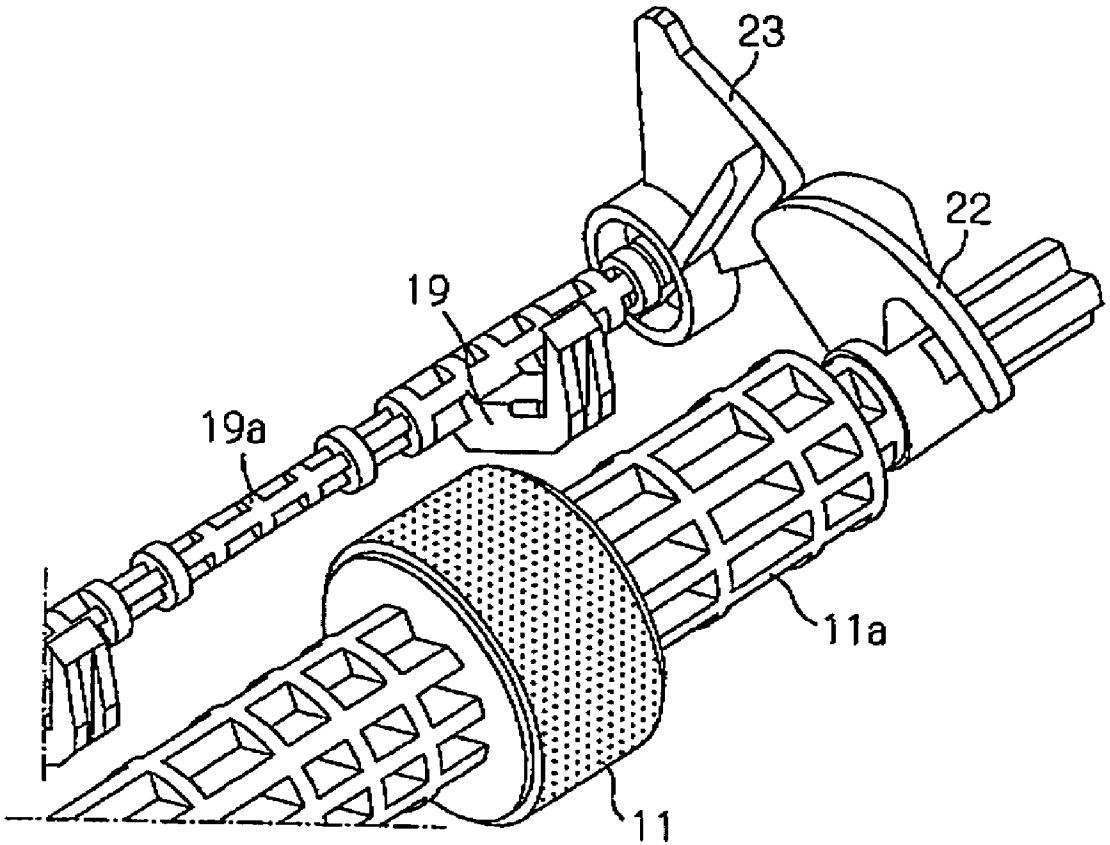
FIG. 3 is an enlarged perspective view of a part of the medium feeder.

As shown in FIGS. 1 to 3, a printer 1 according to one embodiment of the invention comprise a rear medium feeder 2 in a rear part thereof and a front medium feeder 3 in a lower part thereof, respectively operable to feed a recording sheet (hereinafter, referred to as "sheet P") serving as a "recording medium" or an "target medium" to a transporter 5. The sheet P is transported to a recording section 4 (recording head 48) by the transporter 5. The sheet P on which a recording operation is performed is ejected to a stacker (not shown) by an ejector.

Hereinafter, constituent members on a sheet transporting path will be described in more detail. The rear medium feeder 2 includes a frame 10 constituting a base thereof, a hopper 12, a feeding roller 11, a retard roller 13, a returning lever 19, a sheet support 24, a fixed edge guide 16A, and a movable edge guide 16B (see FIG. 2).

The hopper 12 is formed in a plate-shaped body and is provided to be pivotable about a pivot support 12*a*. The hopper 12 is switched into a pressure-contact attitude in which the sheet P supported on the hopper 12 in an inclined attitude is brought into press contact with the feeding roller 11 or a separating attitude in which the sheet P is separated from the feeding roller 11. The feeding roller 11 has a circular shape and rotates to feed the top sheet P to a downstream side. A sheet support 24 (see FIG. 2) extends in a rear side of a sheet supporting face 12*b* of the hopper 12 to support a trailing end of the sheet P.

A supporting face 10*a* on which a leading end of the sheet P set (supported) on the hopper 12 abuts is provided at a position opposing a bottom part of the hopper 12. The leading end of the set sheet P comes in contact with or separated from the feeding roller 11 in accordance with a pivoting operation of the hopper 12 while being slid on the supporting face 10*a*. A guide face 10*b* is provided on a face opposing the feeding roller 11 and the sheet P of which the leading end is separated from the supporting face 10*a* is guided to the guide face 10*b* and moves to the downstream side.

The retard roller 13 has a circumference which is formed of an elastic material and is brought into press contact with the feeding roller 11. The retard roller 13 has a prescribed rotational resistance given by a torque limiter mechanism. Accordingly, when the sheet P is not fed in duplicate and is fed one by one, the retard roller 13 rotates together with the feeding roller 11. When plural sheets are interposed between the feeding roller 11 and the retard roller 13, the rollers do not rotate due to a slipping operation between the sheets, thereby preventing the sheets P at the following position from being fed in duplicate.

The retard roller 13 is axially supported on a holder not shown. The holder is pivotable about a pivot shaft 13*a* and is urged toward the feeding roller 11 by an urging member not shown in the frame 10, The holder pivots, whereby the retard roller 13 is movable back and forth with respect to the feeding roller 11.

The returning lever 19 is an L-shaped member in a side view and is pivotable about a pivot shaft 19*a* in a side view of a sheet feeding path, According to the pivot movement of the returning lever 19, the leading end of the second-top sheet P to be fed in duplicate with the top sheet P is returned to an upstream side, that is, the supporting face 10*a*.

In more detail, the returning lever 19 is configured so that a nipping point between the feeding roller 11 and the retard roller 13 is included in an inner side of a pivoting trajectory of a tip end of the returning lever 19. In the normal standby state, the returning lever 19 takes an attitude (an attitude shown in FIG. 1: hereinafter, referred to as "standby attitude") in which the tip end of the returning lever 19 is placed in an uppermost position and enters the sheet feeding path, whereby the set sheets P do not move toward the downstream side, Immediately when a feeding operation is commenced in this state, the tip end of the returning lever 19 is placed in a lowermost position and takes an attitude (an attitude shown in FIG. 5: hereinafter, referred to as "retreating attitude") in which the sheet feeding path is opened. The returning lever 19 pivots in a direction returning from the retreating attitude to the standby attitude to return the leading end of the second-top sheet P to be fed in duplicate to the supporting face 10*a*.

The pivoting operation of the returning lever 19 is performed in synchronization with the rotation of the feeding roller 11. As shown in FIG. 3, the rotary shaft 11*a* of the feeding roller 11 includes a cam 22 and the rotary shaft 19*a* of the returning lever 19 includes a cam follower 23 engaging with the cam 22. Accordingly, the cam 22 and the cam follower 23 are engaged with each other, whereby the returning lever 19 performs the rotation as described above.

As shown in FIG. 1, a guide roller 40 is provided at a downstream side of the feeding roller 11 on the feeding path of the sheet P. A plurality of guide rollers 40 is provided at proper intervals in the width direction of the sheet P (see FIG. 2) and controls an attitude in which the sheet P fed from the rear medium feeder 2. Here, the sheet P is fed from the rear medium feeder 2 to the transporter 5 at the downstream side in a rolled attitude. When a trailing end of the sheet P is separated from the rear medium feeder 2 (separated from the guide face 10*b*), the sheet P is released from the rolled attitude and the trailing end of the sheet P takes a substantially straight attitude on a rear sheet guide 44.

Since a winding angle (a contact range in a circumferential direction) of the sheet P to a transporting roller 41 is changed before and after the trailing end of the sheet P is separated from the rear medium feeder 2, a sheet transporting force of the transporter 5 is changed, thereby a recording quality would be deteriorated. The guide roller 40 is contrived to solve the above-mentioned problem. The sheet P is pressed against the rear sheet guide 44 by the guide roller 40, whereby the sheet P takes a constant attitude at most before and after the trailing end of the sheet P is separated from the rear medium feeder 2.

As shown in FIG. 1, the front medium feeder 3 provided in a lower part of the printer 1 and configured to set the sheet from a front side of the printer 1 comprises a sheet feeding cassette 25, a pickup roller 26, a feeding roller 28, a separating roller 29, and an assistant roller 30. Plural sheets P are stacked in the sheet feeding cassette 25 which can be mounted and removed from the front side of the printer 1 and the pickup roller 26 which is rotated by a motor (not shown) rotates in contact with a top sheet P set in the sheet feeding cassette 25 so as to eject the top sheet P from the sheet feeding cassette 25. The feeding roller 28 is rotated by the motor and feeds the top sheet P to the transporting roller 41 and a transporting follower roller 42 through the rear sheet guide 44 by leading the top sheet P out of the sheet feeding cassette 25.

The separating roller 29 is provided at a position opposing an outer peripheral face of the feeding roller 28 so as to be movable back and forth to the feeding roller. When the top sheet P is ejected from the sheet feeding cassette 25, the nipping point is formed between the feeding roller 28 so that the leading end of the second-top sheet P to be fed in duplicate with the tip sheet P is retained in the vicinity of the nipping point.

The assistant roller 30 contacts the outer peripheral face of the feeding roller 28. The assistant roller 30 assists a feeding operation of the sheet P with the rotation of the feeding roller 28 by nipping the sheet P with the feeding roller 28. Next, a sheet sensor (not shown) detecting the passing of the sheet P and the rear sheet guide 44 guiding the fed sheet P to the transporter 5 are installed in the rear medium feeder 2 and at the downstream side of the front medium feeder 3.

The transporter 5 comprises the transporting roller 41 which is rotated by the motor and the transporting follower roller 42 axially supported on an upper sheet guide 43 so as to be rotated with the transporting roller 41. The sheet P is transported to the recording section 4 (recording head 48) at the downstream side by the rotation of the transporting roller 41 when the sheet P reaching the transporter 5 is nipped by the transporting roller 41 and the transporting follower roller 42.

The recording head 48 is provided in a lower part of a carriage 46, and the carriage 46 is guided by a carriage guide shaft 47 extending in a primary scanning direction (widthwise direction of the sheet P) and reciprocates in the primary scanning direction by a motor not shown. The carriage 46 mounts ink cartridges (not shown) for supplying a plurality of colors of ink to the recording head 48.

A lower sheet guide 45 is provided at a position opposing the recording head 48 and a distance between the sheet P and the recording head 48 is defined by the lower sheet guide 45. An auxiliary roller 57 preventing the sheet P from floating from the lower sheet guide 45 and the ejector 6 ejecting the sheet P subjected to the recording operation are provided at the downstream side of the recording section 4. The ejector 6 includes an ejecting roller 55 which is rotated by the motor not shown and an ejecting follower roller 56 in contact with the ejecting roller 55.

The ejecting follower roller 56 is a spur roller having a plurality of teeth in the outer periphery thereof and a plurality of ejecting follower rollers 56 are provided in a frame assembly 54 extending in the primary scanning direction to correspond with a plurality of ejecting rollers 55. The sheet P on which the recording operation is performed by the recording section 4 is ejected to a stacker (not shown) which is provided at the front side of the printer 1 by the rotation of the ejecting roller 55 when the sheet P is nipped by the ejecting roller 55 and the ejecting follower roller 56.

As shown in FIG. 2, the fixed edge guide 16A and the movable edge guide 16B each having a guide face 17 are opposed to each other in the hopper 12 and restrict the position of the side edge in abutment on the side edge of the sheet P. The movable edge guide 168 is slidable in a width direction of the sheet P in the hopper 12, thereby shifting the movable edge guide 16B to a position suitable for a width of the sheet P. Hereinafter, when it is not necessary to distinguish the fixed edge guide 16A from the movable edge guide 16B, they are just referred to as "edge guide 16".

Figure 4:
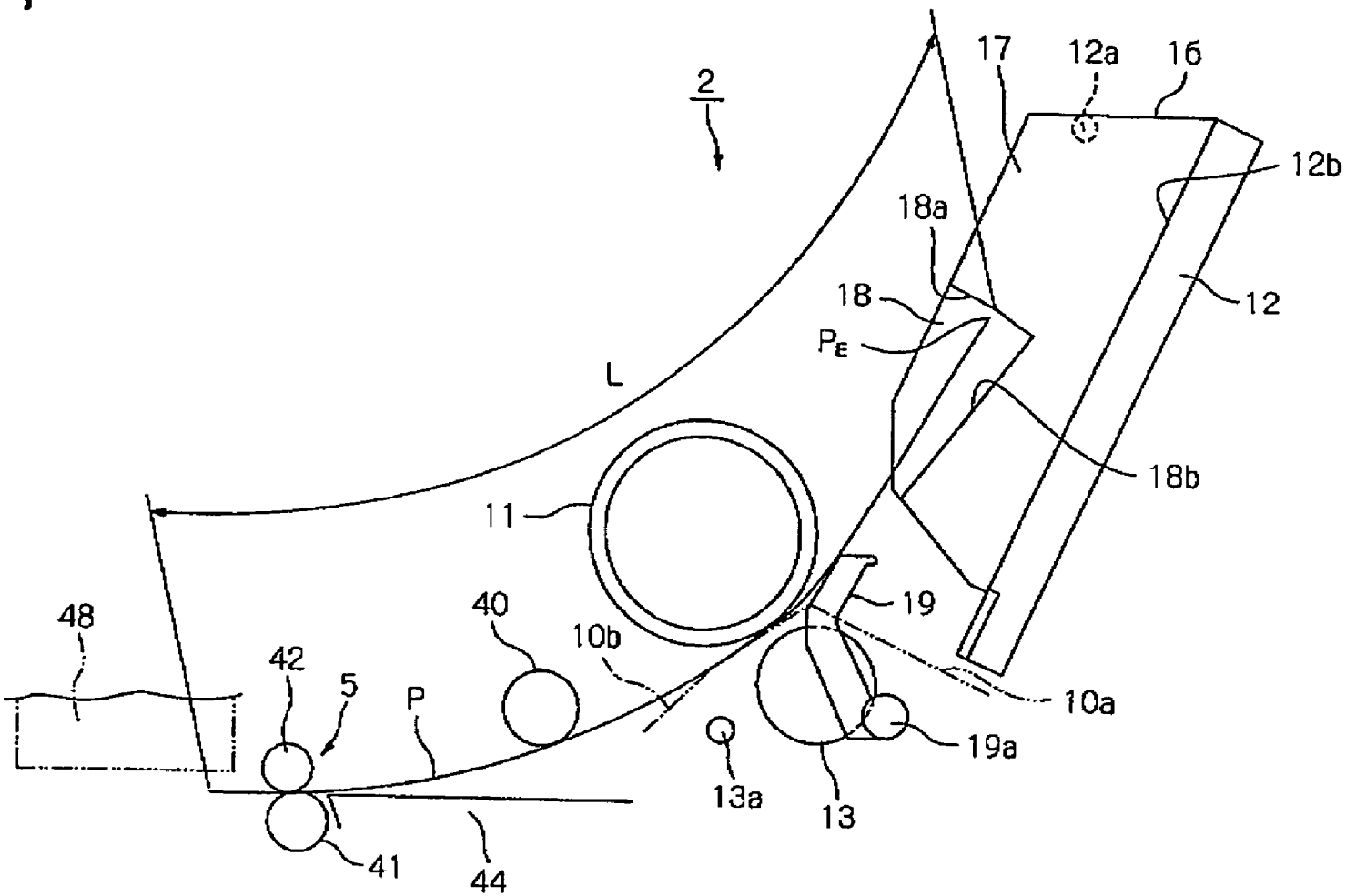
FIG. 4 is a schematic side view for explaining an operation of the medium feeder.

As shown in FIGS. 2 and 4, at the downstream portion of the guide face 17 of the edge guide 16, a concave portion 18 concaved in a direction spaced part from the side edge of the sheet P is formed. The concave portion 18 is separated from the sheet supporting face 12*b* of the hopper 12. On the other hand, when the returning lever 19 takes the standby attitude, the returning lever 19 enters the sheet feeding path so that the fed sheet P is supported on the returning lever 19 from a lower side thereof, that is, the sheet P is pushed up in a direction separated from the sheet supporting face 12*b* of the hopper 12 by the returning lever 19.

The concave portion 18 is formed in a part opposing the side edge of the trailing end of the sheet P pushed up from the sheet supporting face 12*b* of the hopper 12 by the returning lever 19. FIG. 4 illustrates a state (a state where the leading end of the sheet is sent to the position opposing the recording head 48) where the sheet P having a prescribed length (a relatively short sheet: for example, in this embodiment, a photo sheet size of L size or the photo sheet size of 4×6 inch) is positioned at a recording commencement location. As shown in the figure, the edge guide 16 is provided at a position (a position where a trailing end $P_E$ is inserted into an inner side of the edge guide 16) including the trailing end $P_E$ of the sheet P when the sheet P having the prescribed length is positioned at the recording commencement location and is pushed up by the returning lever 19 in the sheet feeding direction.

The concave portion 18 is provided at the position opposing the side edge of the sheet P in the above-mentioned state. Accordingly, when the sheet P is sent to the downstream side by the transporter 5, a gap between the side edge of the sheet P and the edge guide 16 is formed due to the concave portion 18 and the side edge of the sheet P and the edge guide 16 do not contact each other until the trailing end $P_E$ of the sheet P slips out of the edge guide 16, thereby preventing a friction resistance from being generated between the side edge of the sheet P and the edge guide 16. As a result, it is possible to securely prevent the recording quality from deteriorating.

Figure 5A:
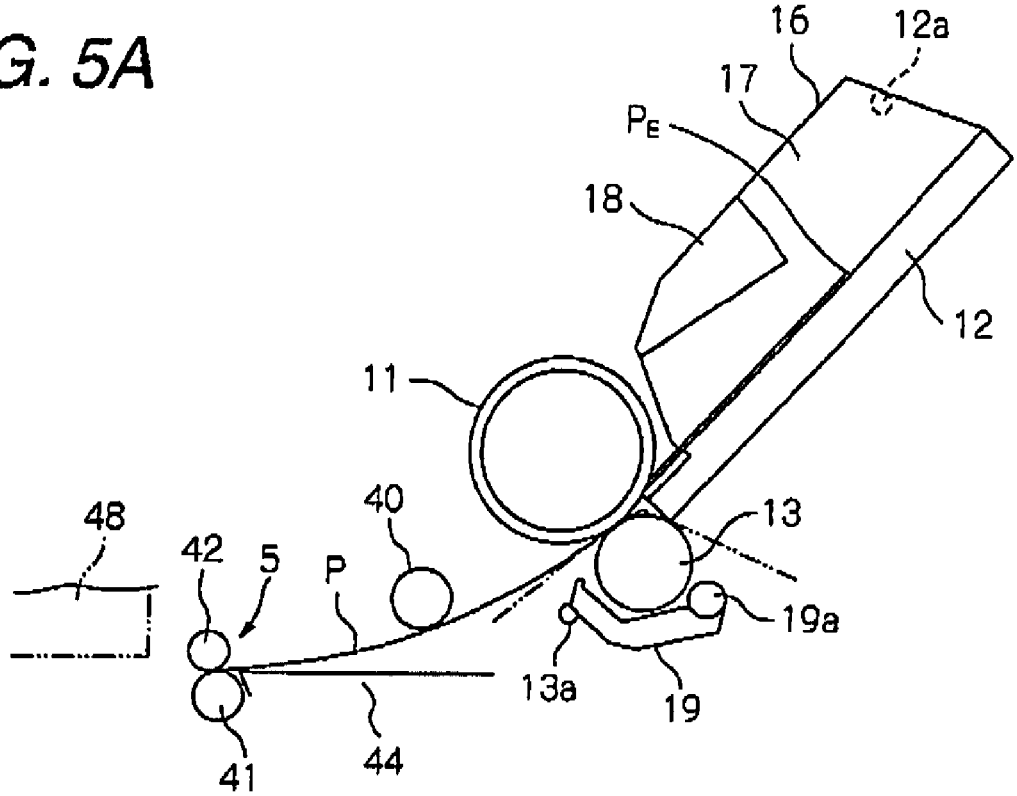
FIG. 5A is a schematic side view showing a state that a single recording medium is supported by a hopper in the medium feeder.
Figure 5B:
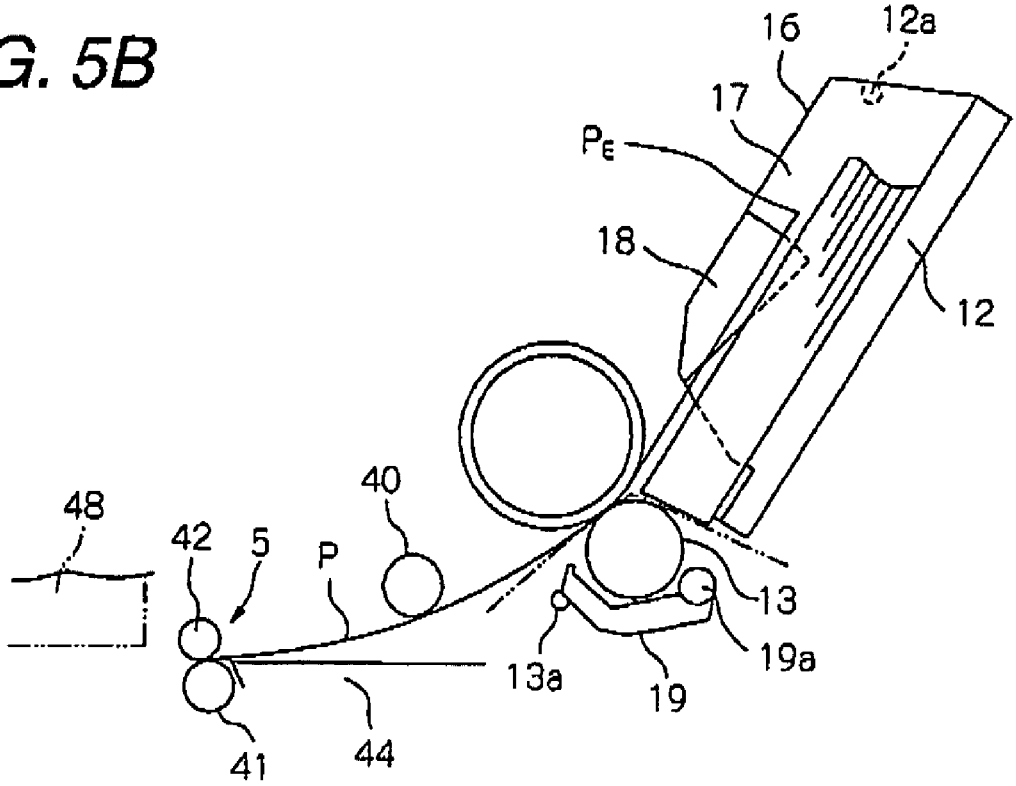
FIG. 5B is a schematic side view showing a state that a plurality of recording media are supported by the hopper.

On the other hand, at the time of feeding the sheet, the sheet P having the prescribed size is firmly restricted by the guide face 17 of the edge guide 16 as shown in FIGS. 5A and 5B. The side edge of the sheet P is restricted by the guide face 17 when the number of sheets of the sheet P stacked on the hopper 12 is the least (one) as shown in FIG. 5A and when the number of sheets of the sheet P is the most as shown in FIG. 5B, thereby securely preventing the skew at the time of feeding the sheet.

That is, in a positional relationship between an upstream edge 18*a* of the concave portion 18 and the trailing end $P_E$ of the sheet P, the trailing end $P_E$ is positioned at an upstream side of the upstream edge 18*a* of the concave portion 18 before feeding the sheet, and the trailing end $P_E$ is positioned at a downstream of the upstream edge 18*a* of the concave portion 18 at the time of commencing the recording operation. Accordingly, it is possible to securely restrict the side edge of the sheet P at the time of feeding the sheet whereas to remove the friction resistance between the side edge of the sheet P and the edge guide 16 at the time of performing the recording operation. When the recording operation is performed, the hopper 12 is positioned at a lower side than the attitude shown in FIG. 5 (the position shown in FIG. 4).

In a case where the length of the sheet P is shorter than a path length L from a recording start position to the upstream edge 18*a* of the concave portion 18, the side edge of the sheet P is securely restricted at the time of feeding the sheet P whereas the friction resistance between the side edge of the sheet P and the edge guide 16 can be removed at the time of performing the recording operation.

When the skew of the sheet P is corrected by inversely rotating the transporting roller 41 under a condition that the leading end of the sheet P is nipped between the transporting roller 41 and the transporting follower roller 42, and that the upstream side of the sheet P is nipped between the feeding roller 11 and the retard roller 13, thereby ejecting the leading end of the sheet P to the upstream side, it is preferable that the side edge of the trailing end of the sheet P opposes the guide face 17, otherwise the skew correction may not be performed properly.

Since the concave portion 18 may be formed at the position opposing the side edge of the trailing end of the sheet pushed up from the sheet supporting face 12*b* of the hopper 12 by the returning lever 19, that is, the concave portion 18 is provided in an upper part of the guide face 17 and may not provided in a lower part of the guide face 17. Accordingly, even in a case where a sheet having a relatively short length (for example, a sheet having a business card size) is fed, such sheets can be stacked on the sheet supporting face 12*b* unless the top sheet does not reach a lower edge 18*b* of the concave portion 18.

In this embodiment, since the returning lever 19 also serves to assist the release of the side edge of the sheet P from the guide face 17, the increase of the parts cost can be avoided.

Figure 6:
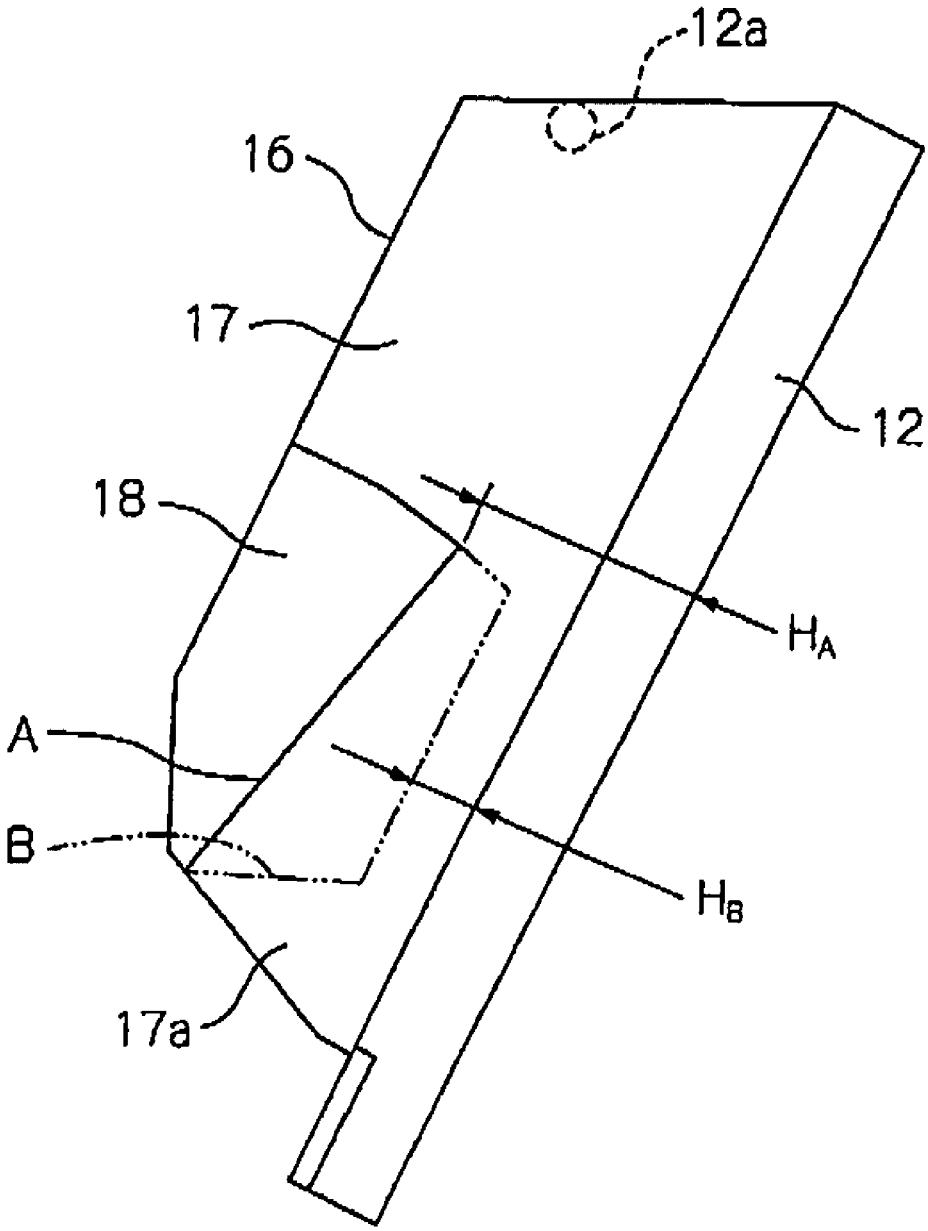
FIG. 6 Is a schematic side view of an edge guide of a medium feeder according to a second embodiment of the invention.

Here, the concave portion 18 is opened to the upper side thereof and to the downstream side thereof as shown by a solid line A of FIG. 6 in this embodiment. In order to suppress an excessive transport load caused by the returning lever 19 when pushing up the sheet P, the lower edge 18*b* of the concave portion 18 may be set at a lower position, thereby reducing the dimension $H_A$ to $H_B$.

Meanwhile, in such a configuration, the number of the above-described short sheet stackable on the sheet supporting face 12*b* is decreased, However, as shown by a dashed chain line B, by configuring the concave portion 18 so as to open to upward only to provide a downstream-side guide face 17*a*, the decrease of the stackable number of the short sheet can be avoided.

Figure 7A:
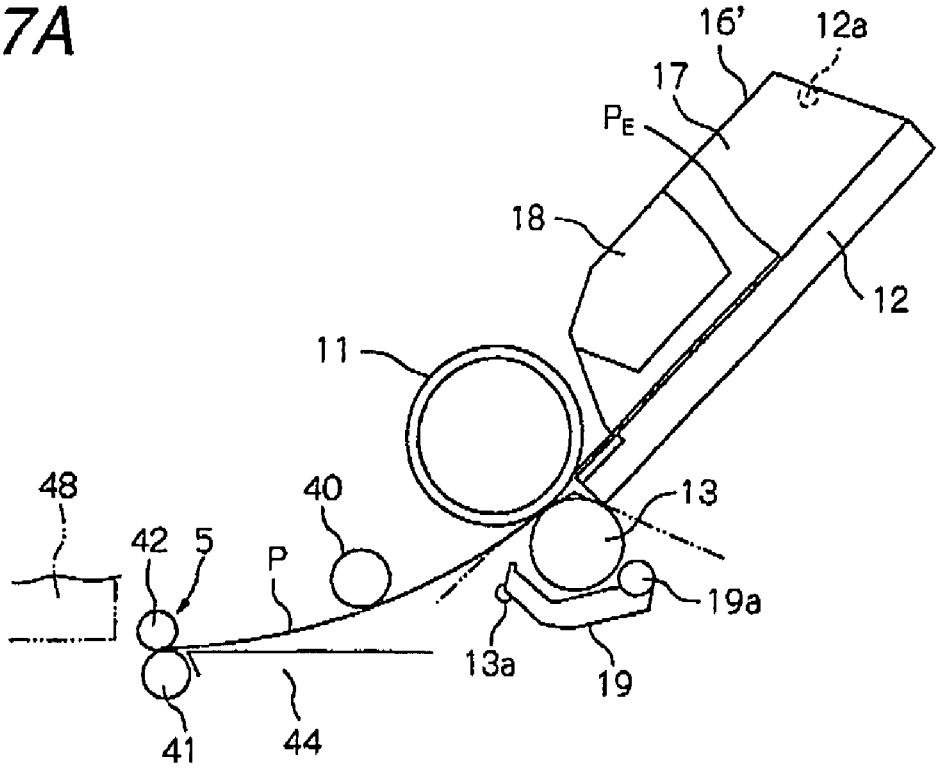
FIG. 7A is a schematic side view of the medium feeder of the second embodiment, showing a state that a recording medium is subjected to a feeding operation.
Figure 7B:
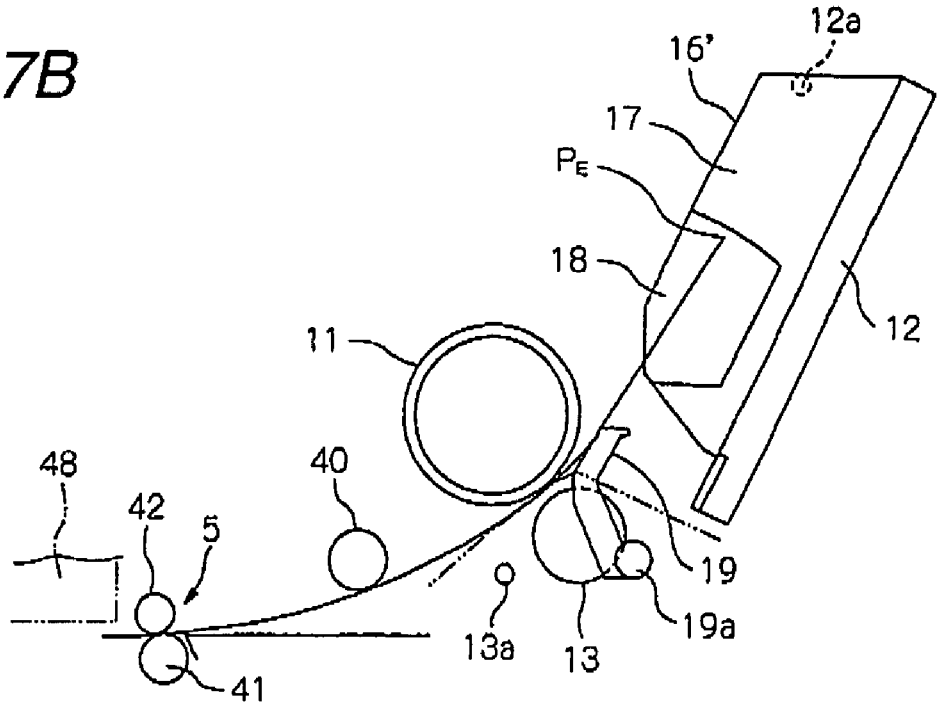
FIG. 7B is a schematic side view of the medium feeder of the second embodiment, showing a state that a recording medium is subjected to a recording operation.

FIGS. 7A and 7B show an edge guide 16' having such a concave portion as a second embodiment of the invention. As shown in FIG. 7A, when the sheet feeding is performed, the side edge of the sheet P is firmly restricted by the guide face 17. As shown in FIG. 7B, when the recording operation is performed, the side edge of the sheet P is opposing the concave portion 18, thereby preventing a friction resistance from being generated between the side edge of the sheet P and the edge guide 16'.

Figure 8A:
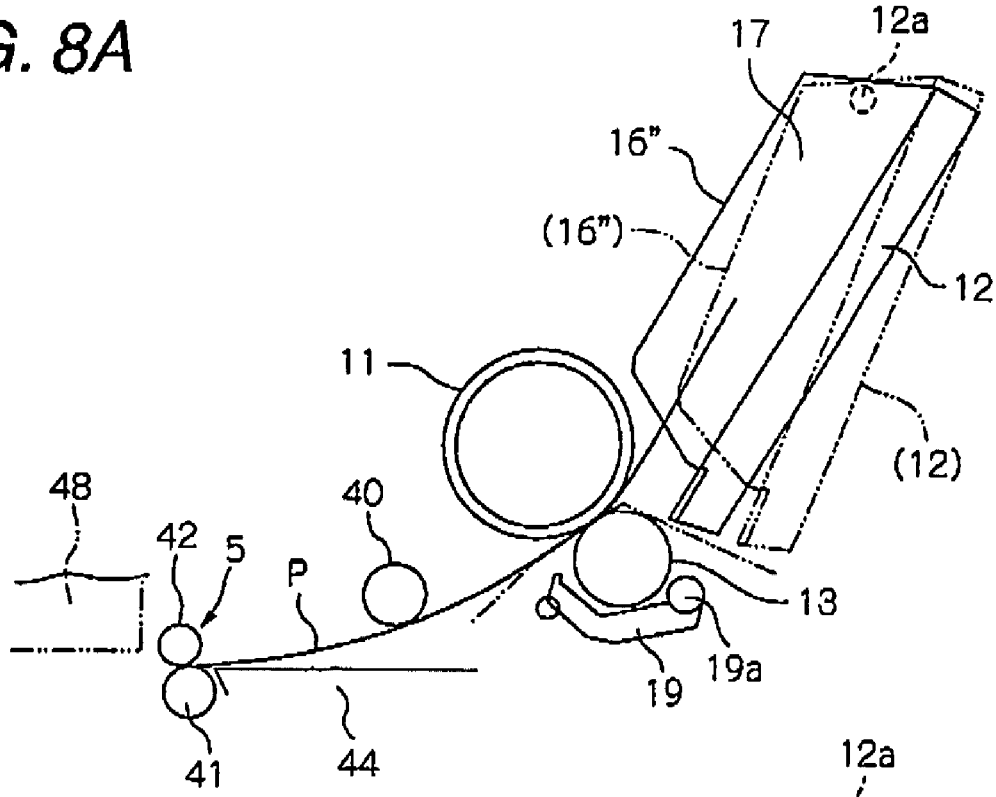
FIG. 8A is a schematic side view of the medium feeder according to a third embodiment of the invention, showing a state that a recording medium is subjected to a feeding operation.
Figure 8B:
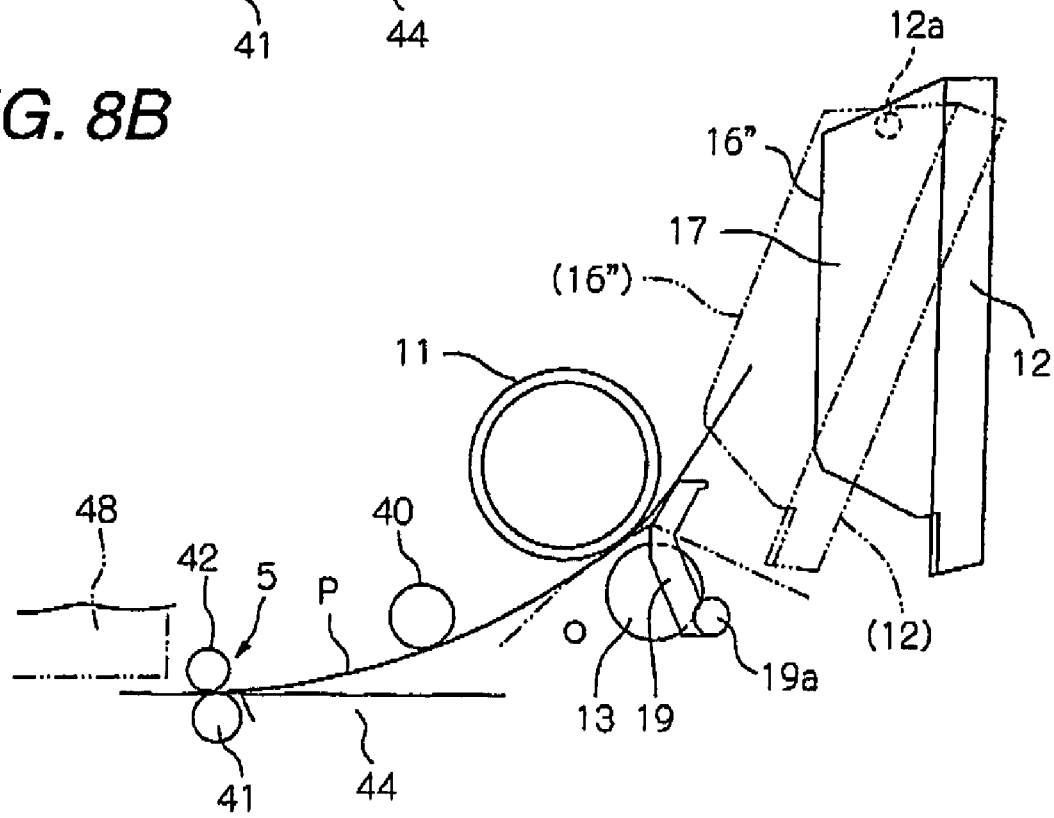
FIG. 8B is a schematic side view of the medium feeder of the third embodiment, showing a state that a recording medium is subjected to a recording operation.

FIGS. 8A and 8B show an edge guide 16" having no concave portion as a third embodiment of the invention. In this embodiment, the hopper is movable between a supporting position shown in FIG. 8A and a releasing position shown in FIG. 8B. The position shown by dashed chain lines in these figures indicates a standby position provided between the supporting position and the releasing position.

As shown in FIG. 8A, when the sheet feeding is performed, the hopper is placed in the supporting position and the guide face 17 of the edge guide 16" firmly restricts the side edge of the sheet P, thereby preventing the skew from occurring. Meanwhile, as shown in FIG. 8B, when the recording operation is performed, the hopper 12 is placed in the releasing position and the side edge of the sheet P is separated from the edge guide 16", thereby preventing the friction resistance from being generated between the side edge of the sheet P and the edge guide 16".

With this configuration, since the hopper 12 and the edge guide 16" per se serve to assist the release of the side edge of the sheet P from the guide face 17, the increase of the parts cost can be avoided.

In this embodiment, the side edge of the sheet P is separated from the edge guide 16" by moving the hopper 12. However, the side edge of the sheet P may be separated from the upper end of the guide face of the edge guide by increasing the amount of which the returning lever 19 enters the sheet feeding path to push up the sheet P.

In this embodiment, since the returning lever 19 also serves to assist the release of the side edge of the sheet P from the guide face 17, the increase of the parts cost can be avoided.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosure of Japanese Patent Application No. 2006-3743 filed Mar. 9, 2006 including specification, drawings and claims is incorporated herein by reference in its entirety.

What is claimed is:

1. A medium feeder, operable to feed a target medium to a liquid ejecting section in which liquid is ejected toward the target medium, comprising:

a feeding roller, adapted to come in contact with the target medium, thereby feeding the target medium along a feeding path in a first direction;

a transporting roller, disposed between the liquid ejecting section and the feeding roller, and adapted to nip the target medium to transport the target medium in the first direction;

a supporter, opposing the feeding roller and having a supporting face adapted to support the target medium;

a returning lever, movable between a first position entering the feeding path and a second position retreating from the feeding path;

a driver, operable to place the returning lever in the second position when a feeding operation of the feeding roller begins, and to place the returning lever in the first position in a state where the target medium is nipped by the transporting roller; and an edge guide, provided on the supporter and having a guiding face adapted to come in contact with a side edge of the target medium at least when the returning lever is placed in the second position, the side edge of the target medium being parallel to the first direction, wherein:

the returning lever is adapted to push up the target medium at the first position thereof, so that the target medium is separated from the supporting face;

the edge guide is formed with a concave portion which is dented in a direction parallel to the supporting face so as to oppose the side edge of the target medium when the target medium is pushed up by the returning lever; and a lower end of the concave portion is spaced apart from the supporting face in a direction orthogonal to the supporting face.

2. The medium feeder as set forth in claim 1, wherein:

the supporter is movable between a third position bringing the target medium in press contact with the feeding roller and a fourth position separating the target medium from the feeding roller;

the lower end of the concave portion is spaced apart from the supporting face when the supporter is placed in the fourth position; and the concave portion is opened upward.

3. The medium feeder as set forth in claim 2, wherein:

the concave portion is opened in the first direction.

4. The medium feeder as set forth in claim 1, wherein:

the returning lever is a pivotable lever operable to return, to the supporter, a target medium second-closest to the feeding roller fed with a target medium closest to the feeding roller, by moving from the second position to the first position.

5. A liquid ejecting apparatus, comprising:

a liquid ejecting section;

a liquid ejecting head, disposed in the liquid ejecting section and operable to eject liquid toward a target medium; and the medium feeder as set forth in claim 1.

6. A medium feeder, operable to feed a target medium to a liquid ejecting section in which liquid is ejected toward the target medium, comprising:

a feeding roller, adapted to come in contact with the target medium, thereby feeding the target medium along a feeding path in a first direction;

a transporting roller, disposed between the liquid ejecting section and the feeding roller, and adapted to nip the target medium to transport the target medium in the first direction;

a supporter, opposing the feeding roller and having a supporting face adapted to support the target medium;

an edge guide protruding from the supporter, extending in the first direction, and having a guiding face adapted to come in contact with a side edge of the target medium, the side edge being parallel to the first direction; and an edge returning lever, operable to place the side edge of the target medium in a first position opposing the guiding face so that the side edge is restricted by the guiding face at least when a feeding operation of the feeding roller begins, and to place the side edge of the target medium in a second position free from the guiding face in a state where the target medium is nipped by the transporting roller.

7. The medium feeder as set forth in claim 6, wherein:

the edge returning lever comprises returning lever, movable between a third position entering the feeding path and a fourth position retreating from the feeding path; and the returning lever is adapted to push up the target medium at the third position thereof, so that the side edge of the target medium is placed in the second position.

8. The medium feeder as set forth in claim 7, wherein:

the returning lever is a pivotable lever operable to return, to the supporter, a target medium second-closest to the feeding roller fed with a target medium closest to the feeding roller, by moving from the fourth position to the third position.

9. The medium feeder as set forth in claim 6, wherein:

the supporter is movable between a third position bringing the target medium in press contact with the feeding roller and a fourth position separating the target medium from the feeding roller; and the edge returning lever is operable to place the supporter in the fourth position, so that the side edge of the target medium is placed in the second position.

10. The medium feeder as set forth in claim 6, wherein:

the edge guide is formed with a concave portion adapted to oppose the side edge of the target medium placed in the second position.

11. A liquid ejecting apparatus, comprising:

a liquid ejecting section;

a liquid ejecting head, disposed in the liquid ejecting section and operable to eject liquid toward a target medium; and the medium feeder as set forth in claim 6.

* * * * *